US010024051B2

(12) United States Patent
Jablonsky et al.

(10) Patent No.: US 10,024,051 B2
(45) Date of Patent: Jul. 17, 2018

(54) EMBEDDED CONCRETE ANCHOR SYSTEM

(71) Applicants: David Jablonsky, Washington Crossing, PA (US); Greg Fleck, Yardley, PA (US)

(72) Inventors: David Jablonsky, Washington Crossing, PA (US); Greg Fleck, Yardley, PA (US)

(73) Assignee: A.L. Patterson, Inc., Fairless Hills, PA (US)

( * ) Notice: Subject to any disclaimer, the term of this patent is extended or adjusted under 35 U.S.C. 154(b) by 0 days.

(21) Appl. No.: 15/337,062

(22) Filed: Oct. 28, 2016

(65) Prior Publication Data

US 2017/0121963 A1 May 4, 2017

Related U.S. Application Data

(60) Provisional application No. 62/248,261, filed on Oct. 29, 2015.

(51) Int. Cl.
*E02D 35/00* (2006.01)
*E04B 1/41* (2006.01)

(52) U.S. Cl.
CPC ..... *E04B 1/4114* (2013.01); *E04B 1/4107* (2013.01); *E04B 2001/4192* (2013.01)

(58) Field of Classification Search
CPC ..... E04B 1/4157; E04B 2001/3583; E04B 1/4114; E04B 1/4107; E04B 2001/4192; E04G 21/185; E04G 21/142; E04G 15/04; F16B 13/124; E01B 9/18
USPC ..... 52/124.2, 125.3, 125.4, 125.5, 677
See application file for complete search history.

(56) References Cited

U.S. PATENT DOCUMENTS 1,491,571 A * 4/1924 Tomkinson ..... E04B 1/4107 248/343
1,511,542 A * 10/1924 Tomkinson ..... E04B 1/4107 52/708
1,929,835 A * 10/1933 Awbrey ..... E04B 1/4107 52/379
3,172,603 A * 3/1965 Bell ..... E01B 9/14 238/265
3,620,277 A * 11/1971 Tummarello ..... E04B 1/4107 411/134
3,640,328 A * 2/1972 Tummarello ..... E04B 1/4128 411/103
3,834,103 A * 9/1974 Knohl ..... E04B 1/4107 52/372
5,257,490 A * 11/1993 Endo ..... E04F 13/0835 52/506.05

(Continued)

*Primary Examiner* — Gisele D Ford
(74) *Attorney, Agent, or Firm* — Ascentage Patent Law, LLC; Travis Lee Johnson; David S. Einfeldt

(57) ABSTRACT

An adjustable location anchor with a greatly increased strength having wide versatility regarding the types of straps or attachments which are usable therewith. The invention includes an extended housing having an interior cavity which includes a main slot and which can include a pair of anterior flanges or wings, wherein the extended housing can be placed into the uncured concrete such that it is rigidly embedded therein upon curing. A sliding insert can then be provided within the interior cavity being configured to slide along a slot formed thereby. The extended housing can also have one or more reinforcement attachment means for connecting to existing concrete reinforcement structures.

17 Claims, 15 Drawing Sheets

(56) References Cited

U.S. PATENT DOCUMENTS

| | | | | | |
|---|---|---|---|---|---|
| 5,542,225 | A * | 8/1996 | Endo | E04F 13/045 | 52/511 |
| 5,623,804 | A * | 4/1997 | Kelly | E04B 1/4107 | 52/704 |
| 5,625,993 | A * | 5/1997 | Kelly | E04B 1/4107 | 52/506.05 |
| 5,641,256 | A * | 6/1997 | Gundy | F16B 13/124 | 411/180 |
| 5,653,563 | A * | 8/1997 | Ernst | F16B 13/141 | 405/259.5 |
| 5,809,703 | A * | 9/1998 | Kelly | E04B 1/4107 | 52/125.5 |
| 9,347,232 | B1 * | 5/2016 | Francies, III | E04G 21/142 | |
| 9,359,779 | B2 * | 6/2016 | Borchardt | E04G 21/3295 | |
| 9,803,354 | B1 * | 10/2017 | Francies, III | E04B 1/41 | |
| 2007/0039281 | A1 * | 2/2007 | Zambelli | E04B 1/4107 | 52/710 |
| 2010/0058677 | A1 * | 3/2010 | Arteon | E04G 21/142 | 52/122.1 |
| 2015/0096242 | A1 * | 4/2015 | Lin | E04G 15/04 | 52/125.5 |
| 2015/0284967 | A1 * | 10/2015 | Kim | E04C 5/12 | 52/125.4 |
| 2016/0017593 | A1 * | 1/2016 | Magee | E04B 1/4121 | 52/699 |

* cited by examiner

EMBEDDED CONCRETE ANCHOR SYSTEM

CROSS-REFERENCE TO RELATED APPLICATIONS

This application claims the benefit of each of the following applications: U.S. patent application No. 62/248,261 which was filed on Oct. 29, 2015 and is herein incorporated by reference in its entirety.

FIELD OF THE INVENTION

The present invention relates to an embedded concrete anchor and strap system for use with a concrete structure.

BACKGROUND OF THE INVENTION

Embedded concrete anchors and straps are used as anchor points for moving, placing, mounting, as well as attachment points for various post installation assemblies.

As concrete is being poured, various reinforcement means, i.e. rebar, mesh, fibers, etc., can typically be used to strengthen the concrete structure. Concrete anchors can be embedded into the concrete which, after curing of the concrete, can allow for attachment of various assemblies into the anchors so as to facilitate the desired function. For example, threaded nuts or hooks can be embedded into the concrete and upon curing and setting of the concrete can then become immobile and allow for interfacing with the anchor, such as threading a corresponding threaded rod into the embedded nut, or attaching a strap or hoist onto the hook. In addition, the concrete anchor system can include a strap which can interface with the anchor and can be used to attach to the concrete structure and maintain the position of the concrete slab position within the concrete structure after placement. In some embodiments, the straps can be disconnected from final exposed surface so as to leave a relatively smooth or clean final surface. In other embodiments, the straps can remain connected to the final system for the purpose of a permanent connection between a particular concrete slab and an adjacent structural system. Additionally, presently available adjustable placement anchors have historically provided lower strength because they rely on the strength of the insert itself rather than on the structural integrity of the concrete slab along with any reinforcement structures. In this manner, the capacity of the anchor will increase as the insert becomes longer and thus is embedded deeper into the concrete from the top surface.

SUMMARY OF THE INVENTION

Contemplated herein is an adjustable location concrete anchor or strap system with increased strength having wide versatility regarding the types of straps or attachments which are usable therewith. The adjustable concrete anchor system includes an extended body embeddable within a concrete slab, the extended body having a slot portion having a predetermined depth and one or more flange portions extending radially outwardly from the slot portion; a sliding insert having a connection portion extending along the depth of the slot portion, the sliding insert also having one or more flange portions corresponding in shape to the one or more flange portions of the of the extended body; and one or more end caps configured to seal opposing ends of the extended body.

In some embodiments, the adjustable concrete anchor system can have a sliding insert having a connection portion and a flange portion which are formed unitarily. Or alternatively, the connection portion and the flange portion of the sliding insert can be formed separately and connected prior to insertion, such as being threaded or bonded together prior to insertion into the extended body. In such a case the flange portion can be provided with a male threaded portion corresponding to a lower female threaded portion of the connection portion.

In yet additional embodiments the adjustable concrete anchor system can include a plurality of grooves or notches on a contact surface of the sliding insert, and a corresponding set of grooves or notches on an opposing surface of the flange portions of the extended body.

It will be appreciated that the sliding insert can include various anchoring means, however, in the embodiments shown herein the sliding insert includes female threads disposed about an interior portion or inner surface of the connection portion for receiving a male threaded screw, bolt, stud, strap, etc.

In some additional embodiments one or more reinforcement attachment means can be provided on an exterior surface of the extended body between the one or more flange portions and the slot portion, or the one or more reinforcement attachment means can be provided on an exterior surface of the end caps, or the one or more reinforcement means can be provided on opposing edges of one or more end cap. In this way, the reinforcement attachment means can be configured to interface with internal support or reinforcement structures embedded within the concrete, the most readily understood example of such being rebar.

In each of these embodiments the extended body can be injection molded, extruded, or machined in any suitable manner so as to provide the extended body in extended lengths such that the extended body can then subsequently be cut to a desired size depending on the allowance of the support structures or the particular dimensions of a given concrete slab.

In order to prevent contamination of the internal channel with concrete during pouring a slot cap can be provided about a top edge of the extended body, wherein the end caps and slot cap hermetically seal an interior cavity of the extended body during and after a concrete curing process.

In some embodiments, in order to aid in the proper placement of the extended body within a given concrete slab spacers can be provided wherein at least one end cap can be provided with one or more spacing footers provided about a bottom edge so as to maintain proper positioning of the extended body within the concrete during curing, which also serves the dual purpose of allowing proper spacing for uncured concrete to flow underneath the extended body during the pouring process.

In alternative embodiments, the appropriate spacing and placement within a curing slab can be achieved by spacing or aligning from a top surface instead of spacing from the bottom surface of a given mold. In order to aid in this proper spacing, the end caps can further also include an extended flange portion extending perpendicularly from an end face about a top edge with an attachment aperture provided therein to screw into or hang from an upper edge of a given concrete mold.

While the extended body can be formed of metallic substances, formed of varying overmolded materials, or formed of differing materials for different portions, it will also be appreciated that the extended body can be formed of a material having a hardness being lower than that of the sliding insert such that under load the extended body will deform and spread the point load at least partially along the channel, as well as aid in the reliability of placement of the particular anchor. As such, the extended body can be formed of a plastic or polymer material and the sliding insert can be formed of a metallic material such as steel. In one particular embodiment, a metal or steel insert on the upper portion of the flange 130 can be over molded with plastic to allow a slight deformation when a load is placed on flange 230 of the insert, so as to prevent cracking in the concrete, while also aids in transferring a portion of the load from flange 230 along a greater portion of the flange 130 and into the concrete slab about which the system is embedded.

Also contemplated herein is a method of providing a concrete anchor system within a concrete slab, the method including the steps of: providing a mold form; providing an adjustable anchor system as described herein: affixing the extended body or at least one end cap to an internal support structure; adding uncured concrete into the mold form around the extended body; allowing the concrete to cure; and removing the slot cap after curing is complete.

In some embodiments of the method can also include additional optional steps such as: providing a plurality of spacing footers about a bottom edge of each end cap; and positioning the spacing footers such that the extended body is spaced away from a bottom surface of the mold form thus allowing for the uncured concrete being added to the mold form to flow beneath the extended body. Alternatively, as discussed briefly above, the positioning can be achieved by hanging the extended body by means of flanges provided about the end caps rather than spacing the extended body from the bottom of the concrete mold.

These aspects of the invention are not meant to be exclusive and other features, aspects, and advantages of the present invention will be readily apparent to those of ordinary skill in the art when read in conjunction with the following description, appended claims, and accompanying drawings. Further, it will be appreciated that any of the various features, structures, steps, or other aspects discussed herein are for purposes of illustration only, any of which can be applied in any combination with any such features as discussed in alternative embodiments, as appropriate.

BRIEF DESCRIPTION OF THE DRAWINGS

The foregoing and other objects, features, and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention, wherein.

DETAILED DESCRIPTION OF THE INVENTION

Figure 1A:
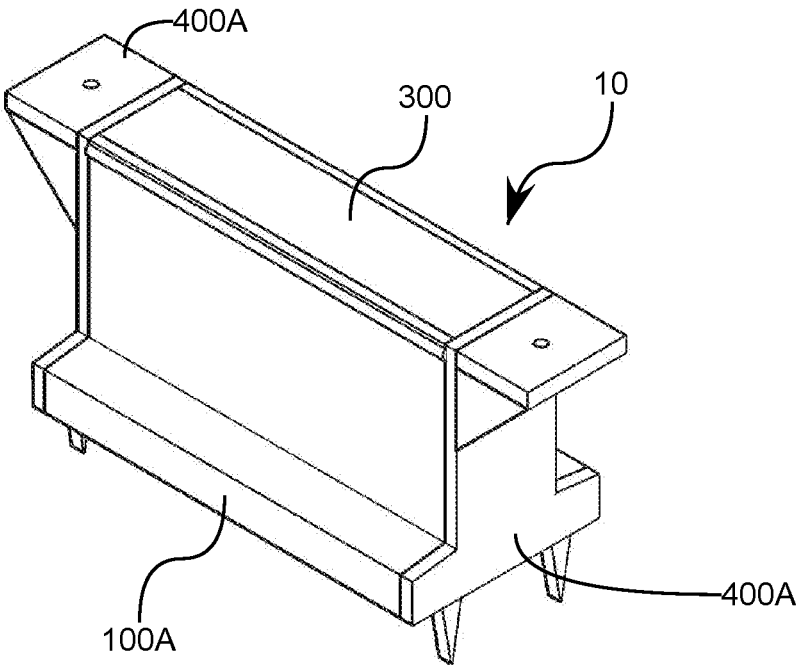
FIGS. 1A-B illustrates perspective assembled and exploded views of a concrete anchor system utilizing a first embodiment of an embeddable extended body with end caps and a top cap in accordance with various aspects of the present invention.
Figure 1B:
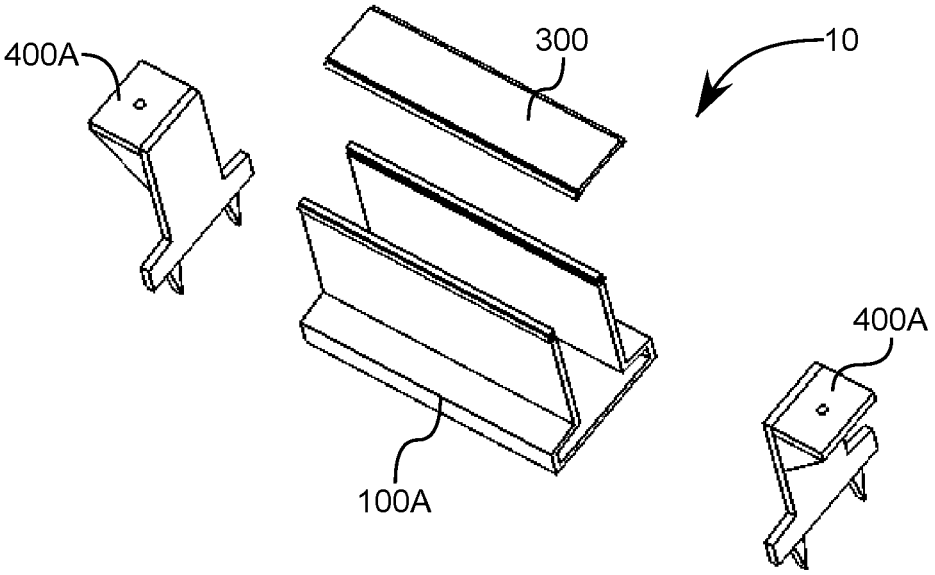
Figure 2A:
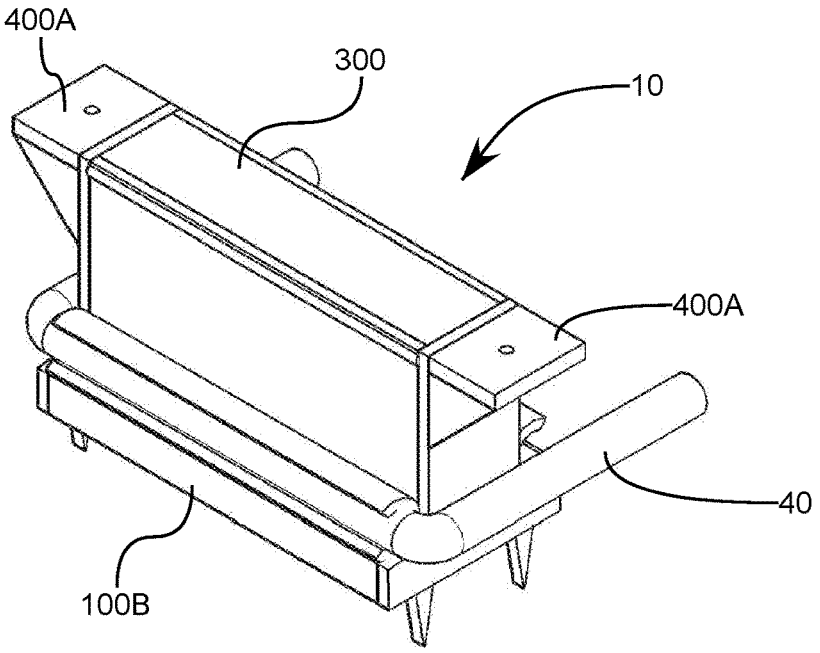
FIGS. 2A-B illustrates perspective assembled and exploded views of a concrete anchor system utilizing a second embodiment of an embeddable extended body with end caps and a top cap in accordance with various aspects of the present invention.
Figure 2B:
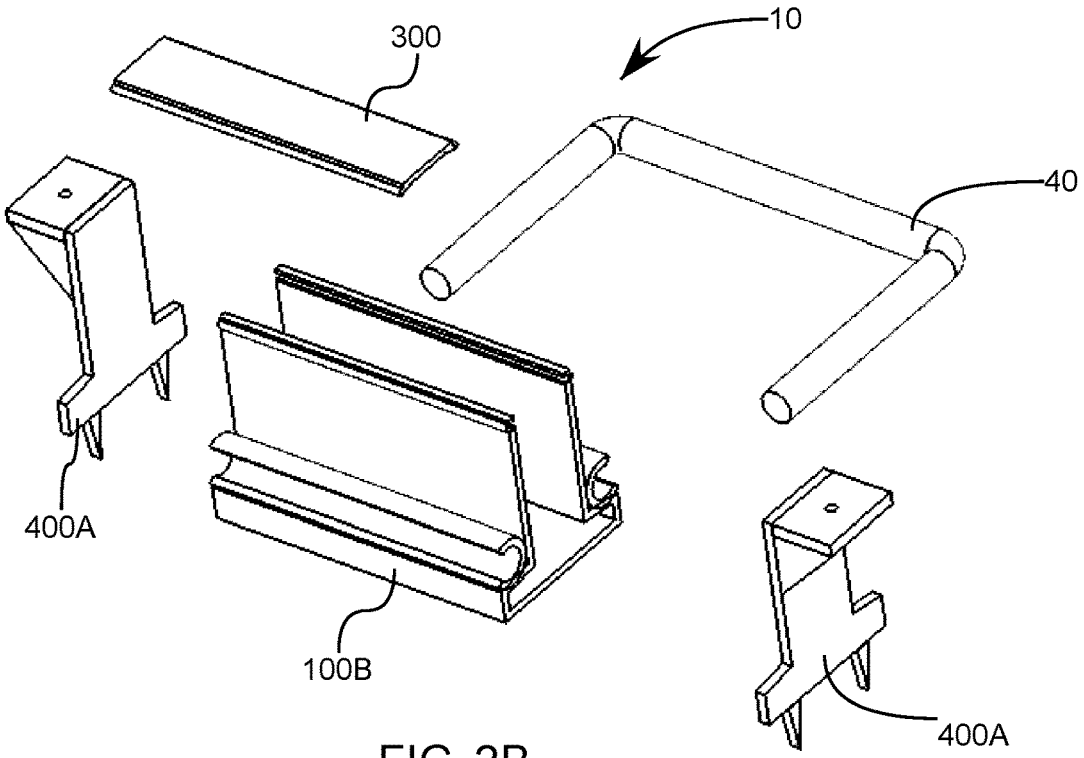
Figure 3A:
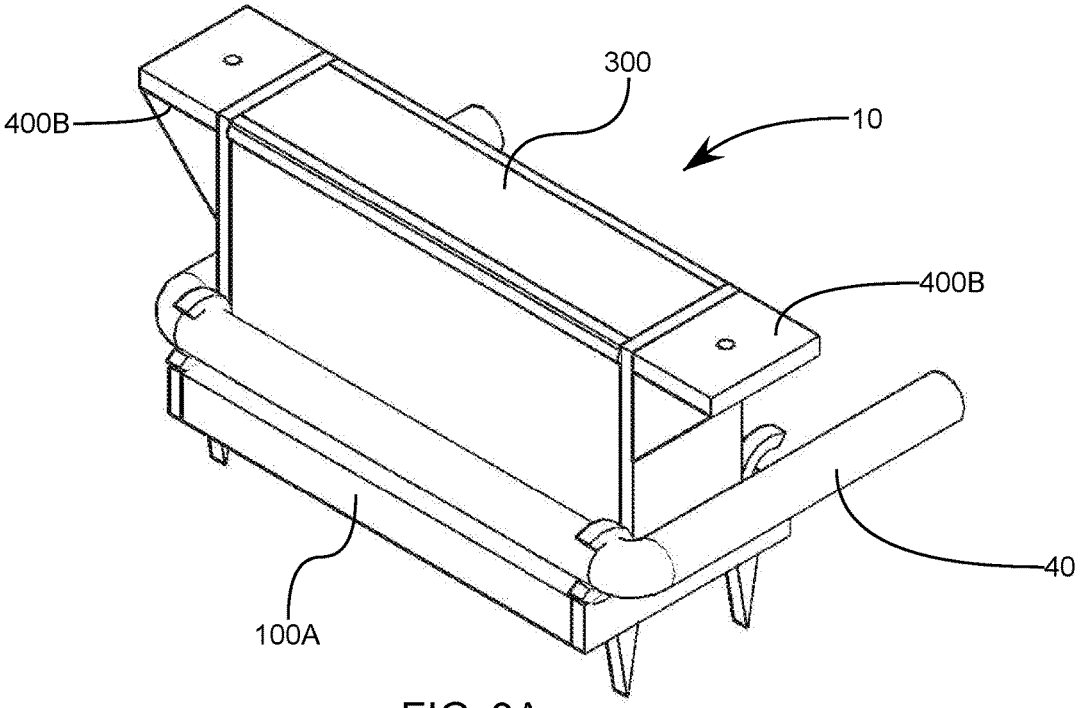
FIGS. 3A-B illustrates perspective assembled and exploded views of a concrete anchor system utilizing a second end cap embodiment for use with various extended bodies as disclosed herein in accordance with various aspects of the present invention.
Figure 3B:
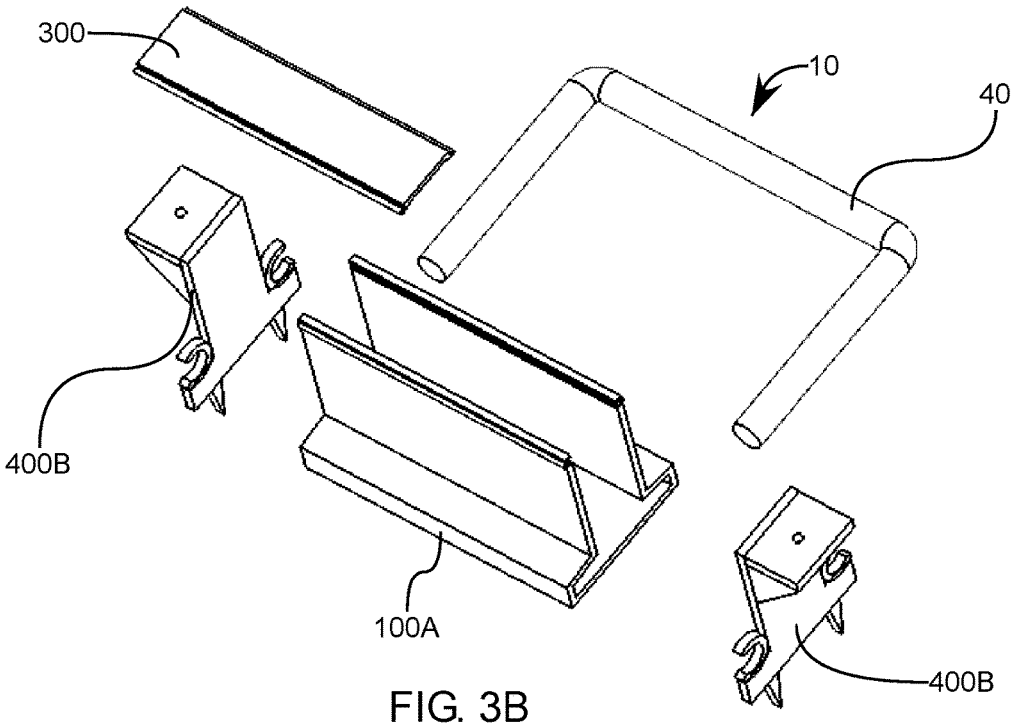
Figure 4A:
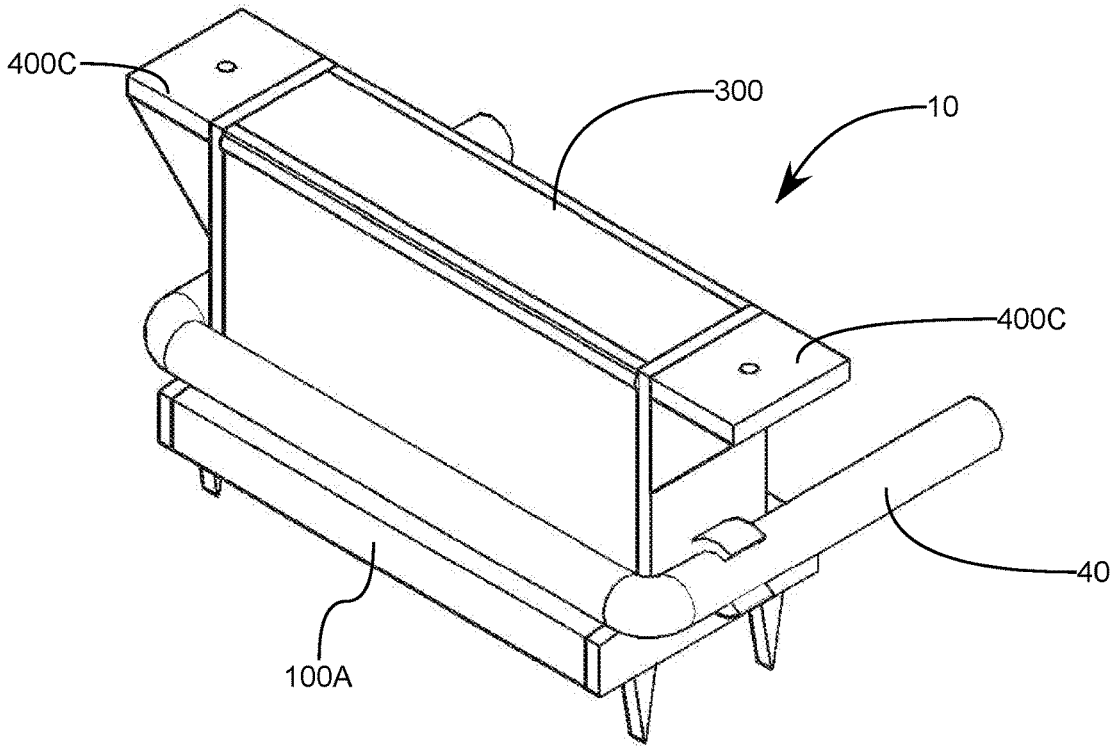
FIGS. 4A-B illustrates perspective assembled and exploded views of a concrete anchor system utilizing yet another end cap embodiment for use with various extended bodies as disclosed herein in accordance with various aspects of the present invention.
Figure 4B:
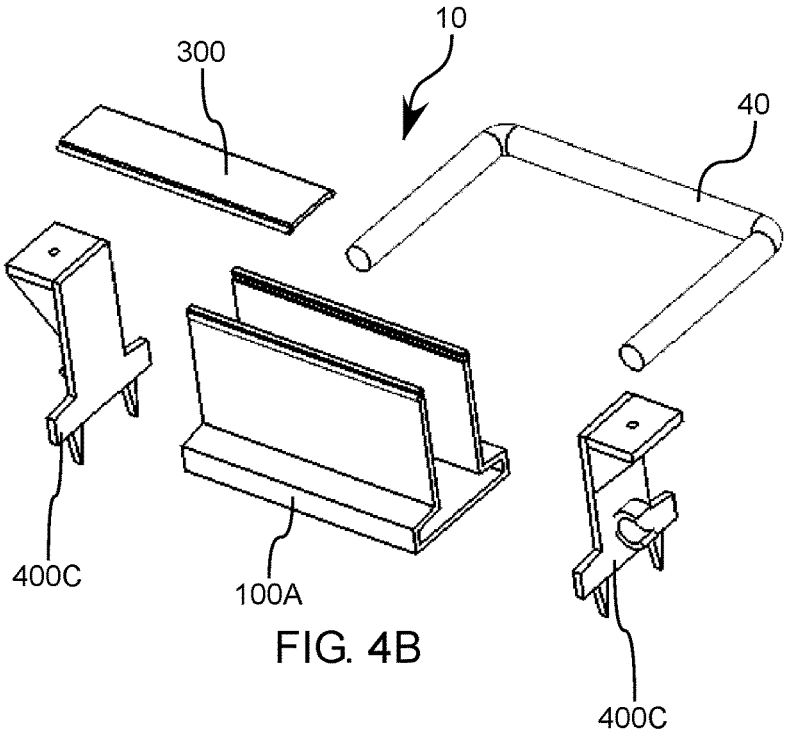
Figure 5A:
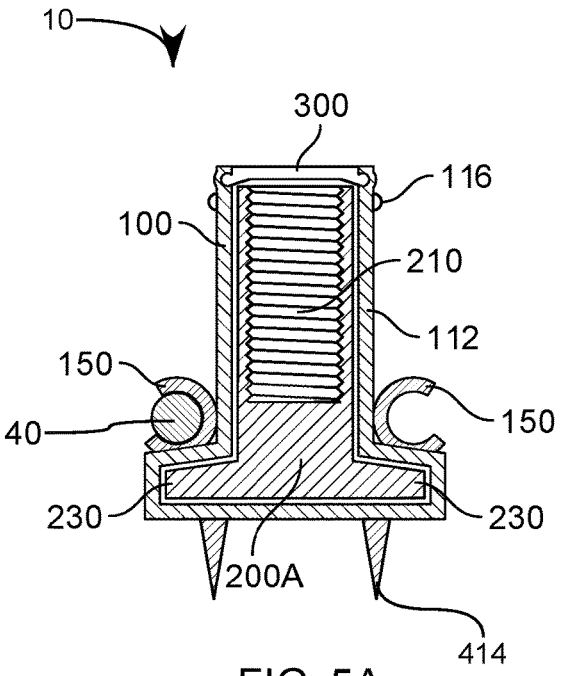
FIGS. 5A-B illustrate end cross-sectional views of an exemplary concrete anchor system assembly in accordance with various embodiments and aspects of the present invention.
Figure 6A:
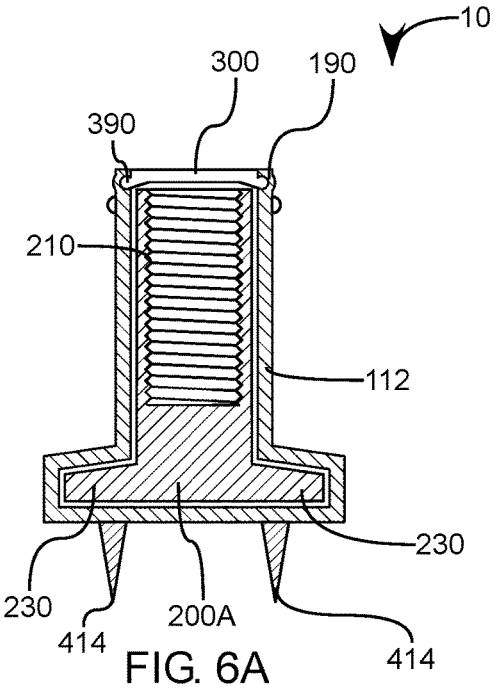
FIGS. 6A-B illustrate end cross-sectional views of yet another exemplary concrete anchor system assembly in accordance with various embodiments and aspects of the present invention.
Figure 5B:
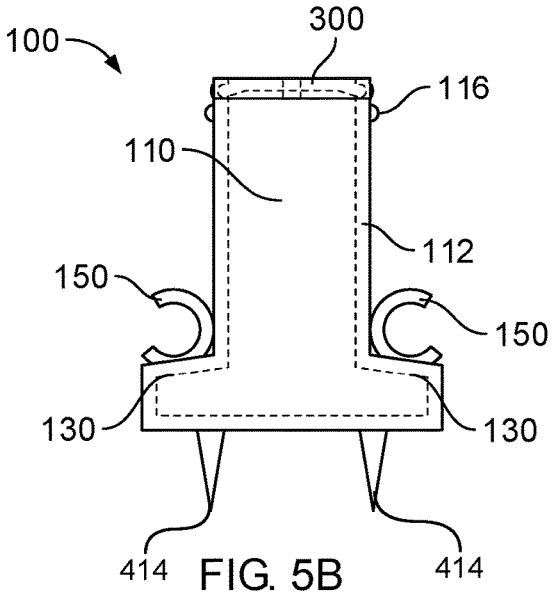
Figure 6B:
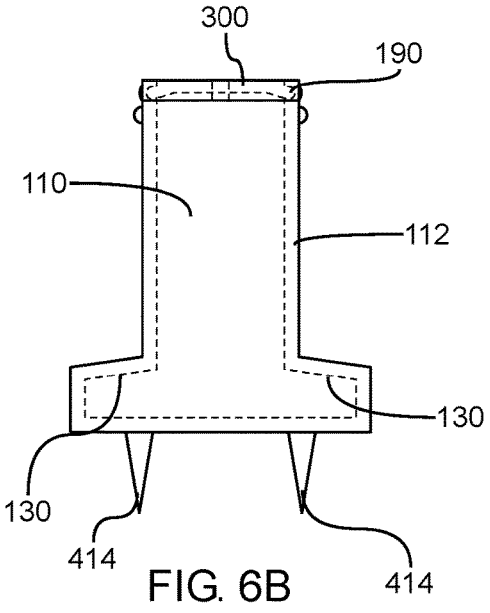

It will be appreciated by those having skill in the area of concrete construction, namely the use of concrete slabs, the placement thereof, and the provision of features on the surfaces thereof, that the strength and reliability of anchors provided thereon is important, particularly with respect to integrity of the concrete slabs and the strength of the anchors as they relate to structural reliability.

Failing of anchors during placement, or after placement during the use of accessories attached to such anchors can often result in the need to replace an entire concrete slab. Additionally, the failure of a particular anchor or the concrete immediately surrounding such an anchor can also result in the destruction or failure of entire structures which depend thereon or it can also compromise the concrete slab itself and the larger structure of which it forms part.

The present invention, as shown in FIGS. 1-24, illustrate various principles and devices which allow for the reliable embedding of an adjustable yet reliable anchor system 10 into a concrete slab 20 which provides increased strength in various dimensions yet is usable with a wide variety of existing external attachments such as threaded straps, studs, threaded rods, etc.

The concrete anchor system 10 can include various components which act together to provide an adjustable anchoring point. These components include various embodiments of an extended body 100A-B, which can be provided in an elongated form which provides a hollow interior or an internal cavity which forms an elongated slot 110. The internal cavity can have various internal contours or features in varying shapes, however, for purposes of illustration, and as shown herein, this internal cavity can have a T-shaped cross section with opposing flanges 130.

A sliding insert 200 can then be provided within the internal cavity which can serve as an attachment point via a connecting portion 210. It will be appreciated that in the embodiments shown the connecting portion is provided as a female threaded tube wherein the top of the connecting portion 210 is flush with the top of the elongated slot. By providing the sliding insert 200 with a threaded connecting portion 210 which is flush with the top of the elongated slot it allows for greater versatility with the different types of connectors and straps which can be used with concrete anchor system 10. This being because the connectors will not have to extend substantially into a deeper section of the elongated slot. However, it will be appreciated that other connection interfaces having internal features as will be ascertainable by those skilled in the art are also contemplated and will be adaptable for use using in the system discussed herein.

The sliding insert 200 can have corresponding flange portions 230 which extend into the flange portions 130 of the extended body 100. In this manner, the sliding insert 200 can have a degree of freedom so as to slide along the length of the elongated slot within the extended body 100.

It will then be appreciated that the flange portions 130 and 230 respectively can be utilized to interact, or interferingly engage, with internal support structure, i.e. rebar 40, as shown in the various embodiments. By engaging with the internal support structure 40 the breakout resistance of the anchor system 10 can be greatly increased. In yet additional embodiments, and as shown in various figures herein, either the extended body 100 or the end caps 400 can be provided with reinforcement engagement means in the form of various clip or engagement features 150, 450, or 454 as illustrated. By providing these engagement features the anchor system 10 can be reliably positioned within the concrete slab and with respect to the reinforcement means during pouring and curing of a new concrete slab.

It will be appreciated that the extended body 100 can be formed of an extruded, injection molded, or cast material in varying lengths, and in this manner can be able to be cut at will to a desired length so as to achieve a desired slot length for any given desired application or so as to fit within or engage with a particular reinforcement means. In some embodiments, the extended body is formed of a metallic substance, however in varying embodiments the extended body can be formed of various plastics or polymers so as to increase the ease of fabrication as well as provide varying deformation properties as well as obtain desired coefficients of friction between the sliding insert 200 and the extended body after being placed within the concrete slab during pouring and after the curing process. The extended body can also have multiple sliding inserts in varying quantities and frequency placed therein. For example, a six-foot length can be formed and have six movable sliding inserts 200 placed at various positions along the six-foot length.

In some embodiments, and as illustrated in various figures, a reinforcement attachment means 150, can be provided along the length of the extended body 100A between the flange portions 130 and the slot or main body walls 112. The reinforcement attachment means 150 are shown herein as one or more semi-circular clips configured to attach to a steel reinforcement bar, i.e. rebar. As such, the clips can have varying elastic properties and diameters so as to allow for attachment to varying sized reinforcement structures such as larger or smaller diameter rebar. Alternatively, the clips 150 can be provided with breaks along their respective lengths so as to allow connection to wire mesh structures and their respective intersections as well as to ensure that air pockets do not form in the concrete along the length of the extended body. Additionally, in order to increase placement reliability and tensile strength, a strengthening rib 116 can be provided on the exterior surface of the main body walls 112.

It will be appreciated that the sliding insert 200 can be corresponding in shape to the interior cavity 110, however, sized slightly smaller than the interior surface of the interior cavity 110 so as to allow for free motion of the sliding insert 200 along the slot. This sizing should take into account the expansion and retraction of the concrete into which it is embedded during the curing process. It will be appreciated that while a small degree of clearance is tolerable that it should not be so great so as to allow the sliding insert 200 to rotate within the lower channel, i.e. the flange portions of the elongated slot. By making the tolerances tighter, the rotational load capacity of each sliding insert 200 can be increased dramatically.

Once the concrete is cured the sliding insert 200 can have an attachment, not shown, threaded into the attachment portion 210 and loaded accordingly. Once a load is applied to the attachment portion 210 the load is transferred to the flange portions 230 and into the corresponding flange portions 130 of the extended body 100.

Figure 18:
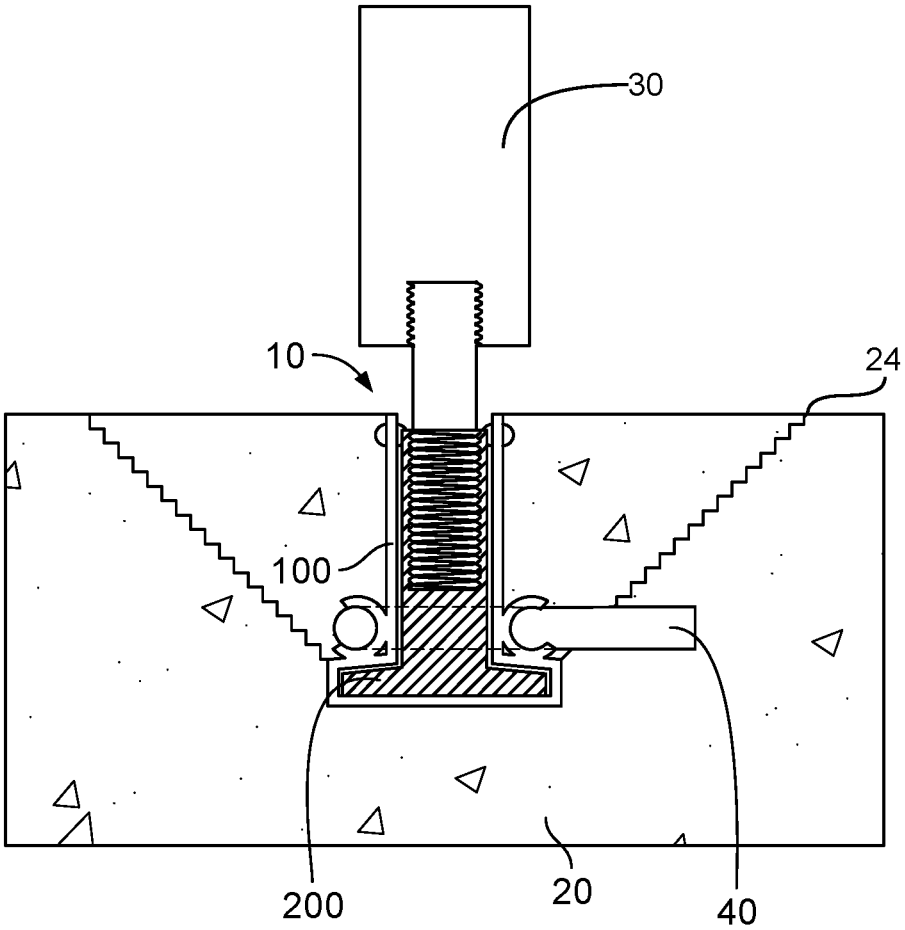
FIG. 18 illustrates a side cross-sectional view of a concrete anchor system as illustrated in FIGS. 2A-B or 3A-B as used in an exemplary concrete slab.

As shown in FIG. 18 the transfer of any load through the sliding insert can then be transferred through the extended body 100 and into the concrete 20. The strength of the anchor system 10 can be increased substantially by further coupling the extended body 100 and the reinforcement attachment means 150 to new or preexisting reinforcement, such as a pre-existing rebar lattice support structure (not shown), or a secondary rebar reinforcement member 40 as shown.

In some instances, an anchor system 100 will have a desired placement near an edge of a concrete slab 20, which will then be lacking preexisting reinforcement structures. In such instances a secondary reinforcement member 40 can be provided which interfaces with the attachment means 150 of the extended body 100 and can provide additional edge support to the extended body 100 about a concrete edge. The secondary retention members 40 can be placed within the curing concrete at edge portions which would typically be weaker, wherein the secondary retention member 40 can substantially encompass the entire length of the extended body 100 and then tie in with existing support structure further toward the center of the concrete slab and thus act as a reinforcement means so as to prevent breaking the anchor out of the edge portion of the concrete.

As discussed above, the extended body 100 can be formed of various materials including plastics, polymers, and metals. In some embodiments, it has been recognized that certain deformable plastics increase the ease at which the extended body can be formed during the extrusion process. One advantage from using a deformable material is that when the sliding insert is presented with a load, the flange portions 130 can deform slightly and thus better disperse the load over the local flange area so as to account for any incontinuities between the respective sliding insert flange and the edge of the concrete between which the portion of the extended body and the flange is pinched. However, more rigid materials allow the load to be transferred along the length of the extended body 100 over a slightly larger overall surface area thus reducing the point load at a specific point, wherein it is readily understood that concrete does not sustain point loads well. It will thus be appreciated that by varying the elastic properties of the material forming the extended body 100 that a desired balance between ease of manufacture, incontinuities, and load dispersion will be beneficial.

Additionally, the attachment means 150 can be further utilized to further transfer a load on the sliding insert 200, through the intervening concrete, or through the extended body 200, and into the internal reinforcement structure 30, i.e. the rebar or wire mesh.

For purposes of initial embedding the extended body 100 can be provided with end and top caps, 310 and 300 respectively, which cover the exposed ends as well as the exposed top slot as the extended body is placed into the wet concrete.

The top and end caps can have one or more locking protrusions which extend into and interface with corresponding locking features provided on the interior surface of the internal cavity of the extended body. Such an interface can include locking features as shown in FIGS. 5-6, which includes a sealing channel 190 and corresponding top cap protrusion 390, but can include additional sealing methods such as press or interference fits in any suitable manner as will be appreciated by those having skill in the art.

In this manner, concrete can be prevented from flowing into, and thus fouling the internal cavity and prevent the sliding insert 200 from moving along the length of the elongated slot after curing is complete. For purposes of providing an adequate seal, the sliding insert will be provided either flush with the top of the elongated slot or slightly recessed therein such that the top cap 300 can seal along the top edge of the elongated slot. After curing, the top cap 300 can be removed and the sliding insert can then freely slide along the length of the elongate slot for proper positioning and attachment of any desired accessories or features, such as straps for moving, or final attachment to existing structures, etc.

Other advantages of having a substantially sealed internal cavity 110, and thus eliminate any moisture therein, is that it allows for greater versatility of the various types of materials which can be used for the sliding insert 200. Namely, because there is no moisture penetration, high strength carbon steel can be used which would have had rust problems in a direct contact embedded anchoring system. It will be appreciated that stainless steel or any other material may also be used; however greater versatility is thus provided in the current system. In addition, plastic often affords better corrosion resistance than metal inserts, thus this factor can also be taken into account for design concerns.

Additionally, by allowing for a deeper embedding, the tensile strength of each anchor can be increased substantially, depending on the thickness of the concrete into which it is embedded. This system, by allowing for deeper embedding also allows for use of larger diameter anchors as the extended body is able to be coupled to the embedded reinforcing structures. These larger diameter anchors then can further sustain higher shear loads as well prior to either shearing off the sliding insert 200, which is reinforced in shear by the surrounding concrete, or by requiring shearing through a larger attachment affixed thereto.

Figure 7A:
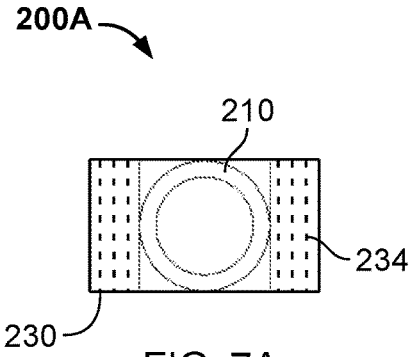
FIGS. 7A-B illustrate top views of various exemplary embodiments of various sliding inserts for use with the concrete anchor system assembly disclosed herein in accordance with various embodiments and aspects of the present invention.
Figure 7B:
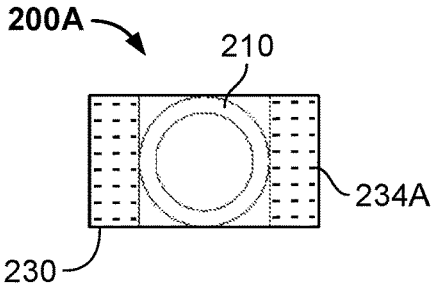

In some additional embodiments, and as shown in FIGS. 7A-B, a plurality of meshing slots and/or grooves 234 and 234A can be provided along top surfaces of each of the sliding inserts 200 with corresponding slots and/or grooves which can be provided in the corresponding surfaces of the flange portions 130 which engage with one another and can thus provide incremental adjustment and position retention prior to, during, and subsequent to loading of the sliding inserts 200 within their respective channels.

Further illustrated in FIGS. 8-9, 10A, 11A, 12, and 13A-E are various embodiments of sliding inserts, 200A-J respectively. In particular, these figures illustrate how the neck portions 204A-C can have varying thicknesses or alternatively chamfered or faceted outward edges according to strength demands. Also, illustrated in FIGS. 13A-E are views of various additional embodiments of sliding inserts 200E-I having alternative round or other alternative geometric shapes forming the respective threaded portions 210E-I respectively, with varying dimensions for flanges 230E-I respectively and/or threadwalls, etc. As such, it will be appreciated that the flange length can be increased in length or thickness as well as thread depth or threadwall thickness. FIGS. 14A-E illustrate top views of respective sliding inserts 200E-I, wherein it is also appreciated that the threadwalls can be circular or square and in varying sizes with respect to the flange portions so as to limit twisting or unwanted shifting of the sliding insert with respect to the channel.

Figure 8:
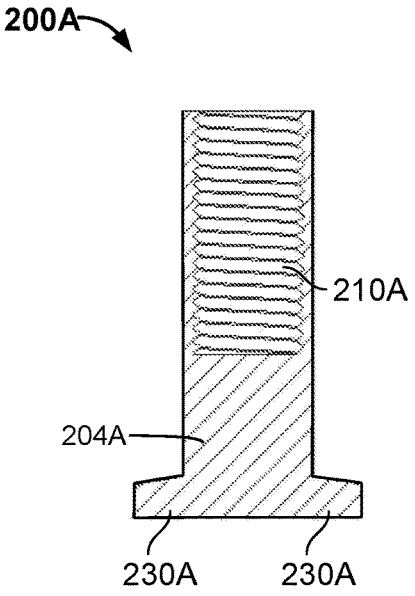
FIG. 8 illustrates a side cross-sectional view of yet another sliding insert adaptable for use with the concrete anchor system as disclosed herein in accordance with various embodiments and aspects of the present invention.

Alternatively, FIG. 8 illustrates a unitary sliding insert construction which includes a typical unitary construction with a lower flange portion 230A and an attachment portion 210 having internal female threads in the attachment portion 210 being connected by an intermediate neck portion 204A which can vary in thickness as discussed above.

Figure 9:
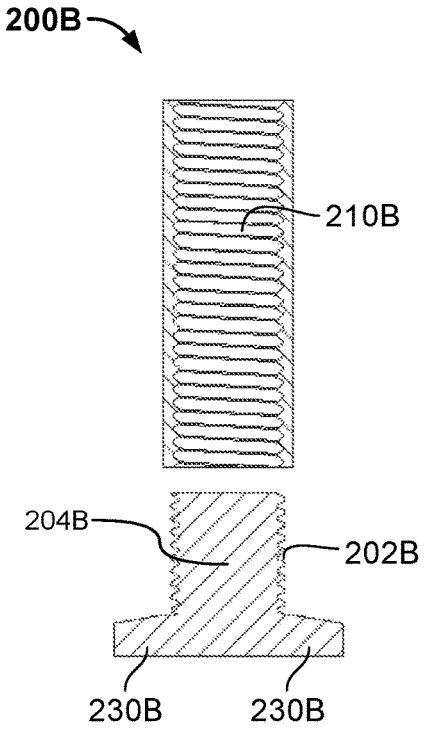
FIG. 9 illustrates a side cross-sectional view of yet another sliding insert assembly adaptable for use with the concrete anchor system as disclosed herein in accordance with various embodiments and aspects of the present invention.
Figure 10A:
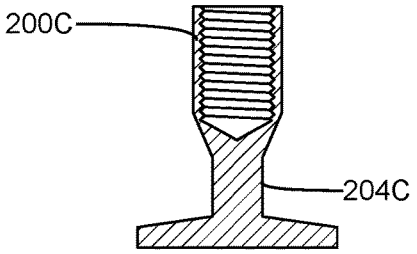
FIGS. 10A-C illustrate various side cross-sectional views of yet another embodiment of an embeddable extended body and associated sliding insert in accordance with various embodiments and aspects of the present invention.
Figure 11A:
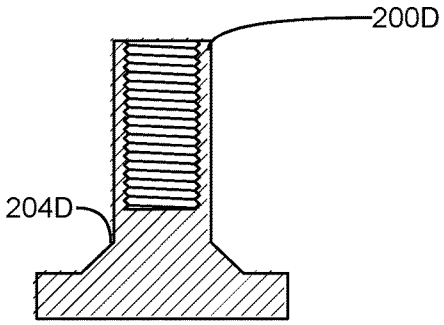
FIGS. 11A-C illustrate various side cross-sectional views of yet another embodiment of an embeddable extended body and associated sliding insert in accordance with various embodiments and aspects of the present invention.
Figure 10B:
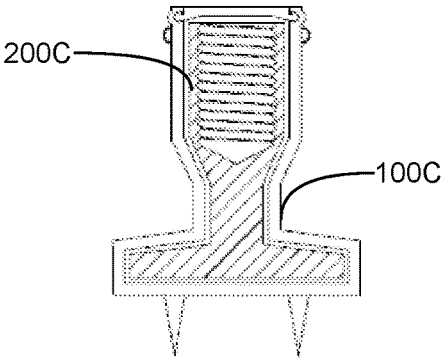
Figure 11B:
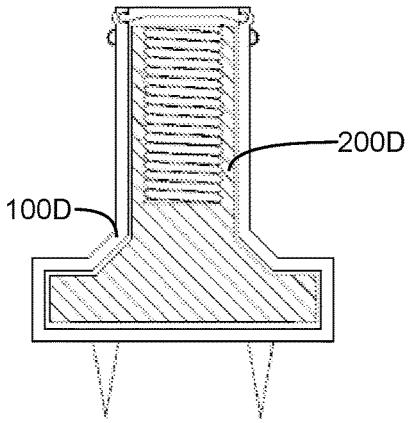
Figure 10C:
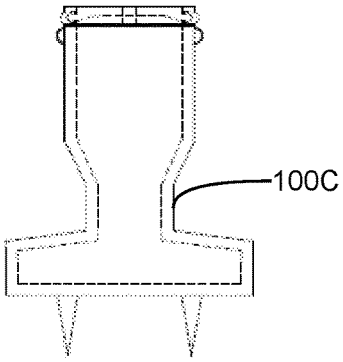
Figure 11C:
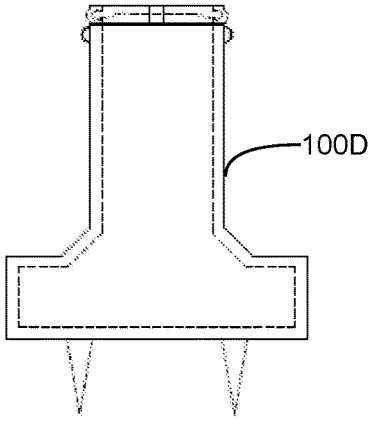
Figure 12:
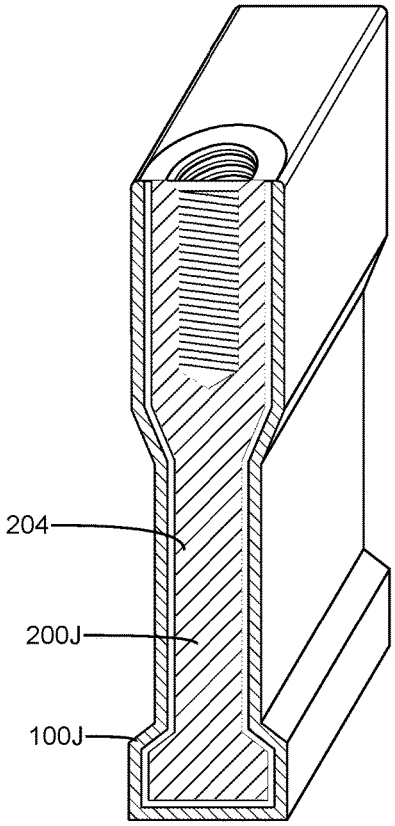
FIG. 12 illustrates a perspective side cross-sectional views of yet another embodiment of an embeddable extended body and associated sliding insert in accordance with various embodiments and aspects of the present invention.
Figure 13A:
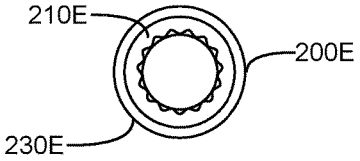
FIGS. 13A-E illustrate top views of various sliding inserts configurations for use with the various extended bodies as disclosed herein in accordance with various embodiments and aspects of the present invention.
Figure 13C:
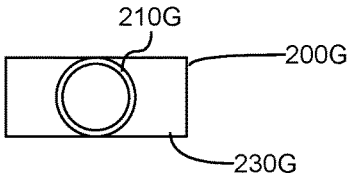
Figure 13E:
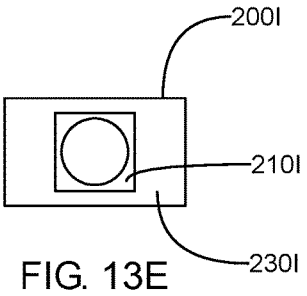
Figure 13B:
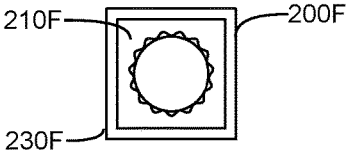
Figure 13D:
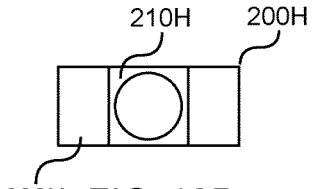
Figure 14A:
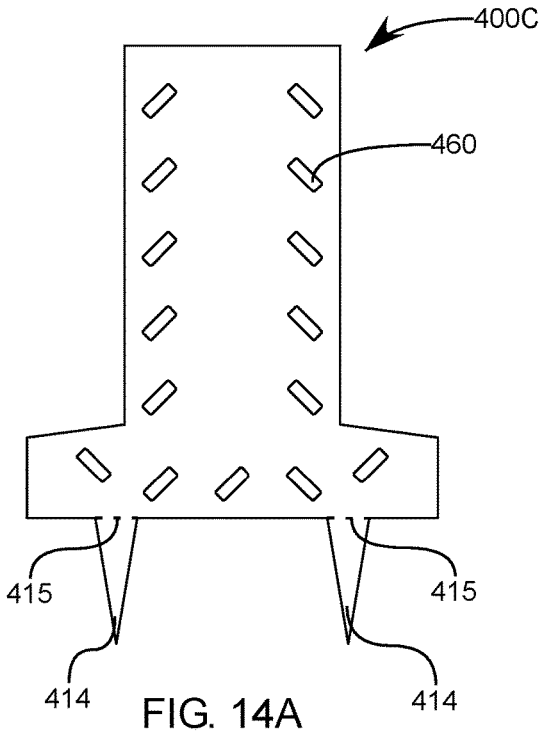
FIGS. 14A-D illustrate front, back, side, and top views respectively of yet another alternative end cap for use with the concrete anchor system as disclosed herein in accordance with various embodiments and aspects of the present invention.
Figure 14B:
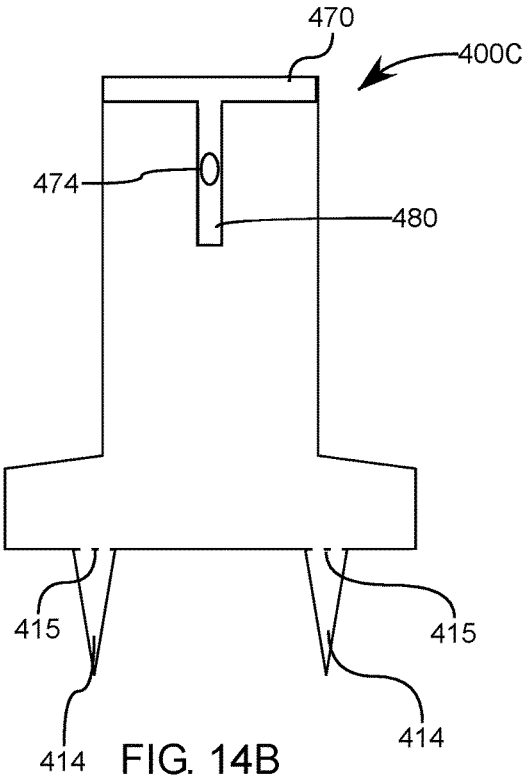
Figure 14C:
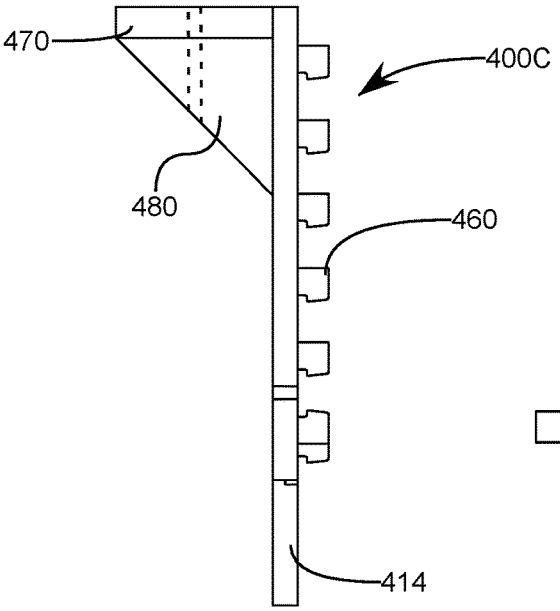
Figure 14D:
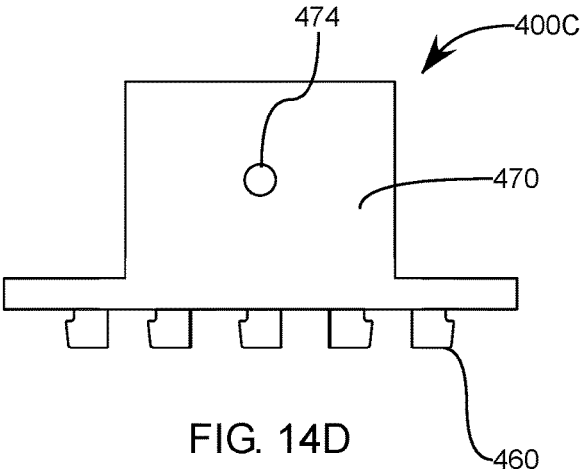
Figure 15A:
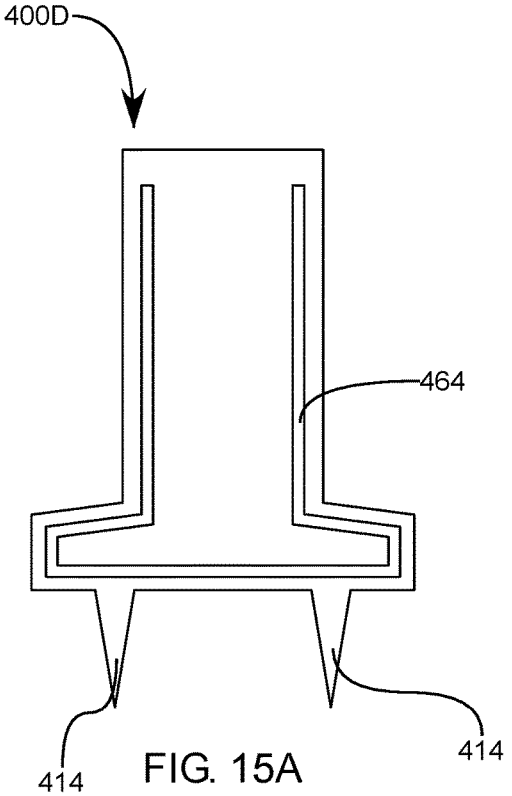
FIGS. 15A-C illustrate rear, side, and top views respectively of yet another alternative end cap for use with the concrete anchor system as disclosed herein in accordance with various embodiments and aspects of the present invention.
Figure 15B:
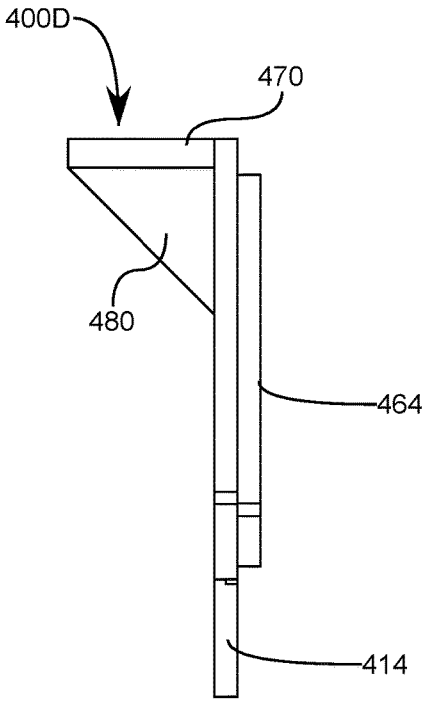
Figure 15C:
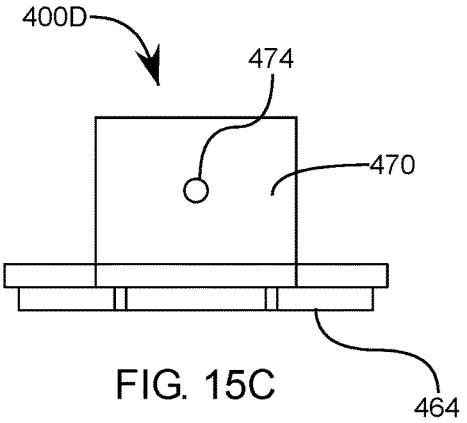

Alternatively, FIG. 9 illustrates an alternative sliding insert 200B which includes a male threaded flange portion 202B having relative flanges 230B, which threads into a bottom portion of an attachment portion 210B which here is illustrated as a female threaded rod with threads along its entire length. It will be appreciated that the two-piece system as shown in FIG. 9 may often be easier to manufacture separately so as to provide more versatility for corresponding channel depths, flange widths, etc. for a given application and what will be allowed by a particular concrete slab and/or internal support structure. It will be further appreciated that the male and female portions can be reversed in this situation. Additionally, the embodiment as shown in FIG. 9 allows for easy adaptation of different slot depths of various extended body configuration, or flange widths simply by selecting the desired component length or width, whereas the unitary embodiment as shown in FIG. 8 will need to be custom machined or manufactured for every variance in the dimensions of each particular extended body.

Additionally, because each sliding insert 200 has a female threaded attachment portion wherein any number of sliding inserts can be chosen with any number of thread lengths it allows for threads to be provided which are flush with the top edge of the slot of the particularly selected extended body 100. As such the anchor system 10 is adaptable for use with a wide variety of exiting attachment accessories and systems. By providing the threads right at the concrete surface, the threads engage immediately and are not embedded too far to reach by many existing attachment mechanisms. It will be readily appreciated that a larger number of engaged threads in a threaded system, the stronger the connection will be. This orientation allows for a maximum amount of engaged threads. Additionally, when the sliding insert 200 is flush with the top surface and extends deep into the concrete, side shear capacity is increased as the entire side of the insert 200 can thus bear onto the side of the concrete uniformly over the entire depth which in turn reduces stresses in the concrete.

It will be appreciated that the increased depth allows for a longer threaded portion of the connection interface of the sliding insert. As such, the longer threaded portion allows for the use of any one of the Unified Thread Standards including but not limited to UNC, UNF, UNEF threads, metric threads, coil threads, or any number of threads having different pitches and spacing coarseness or fineness, wherein the depth allows for threads of any number of different parameters.

Figure 20:
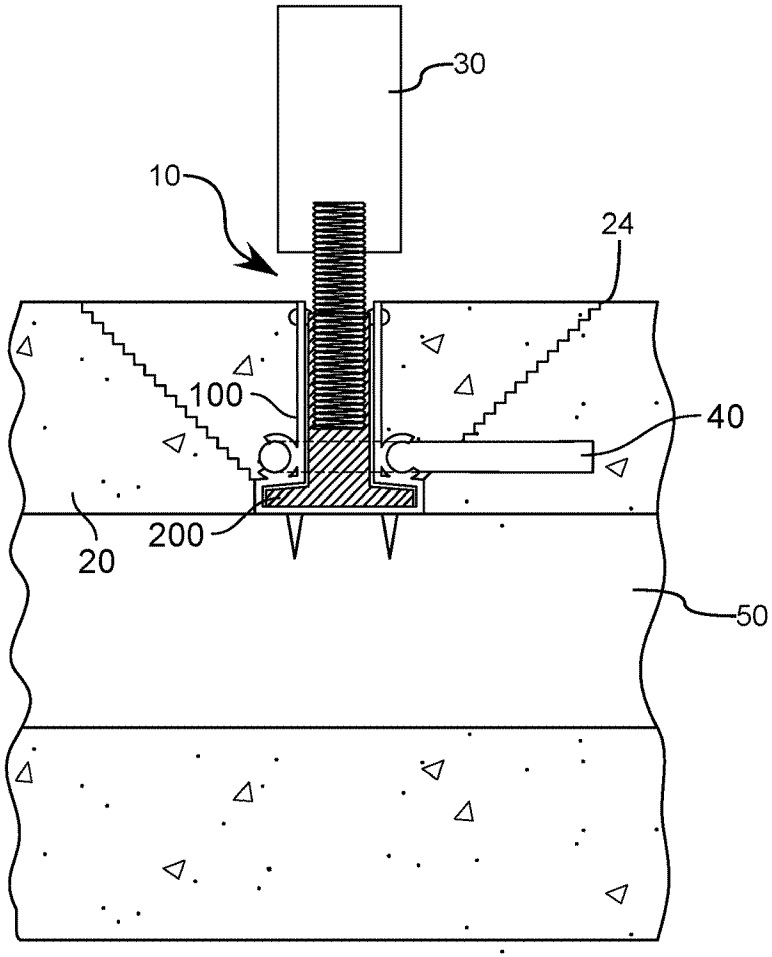
FIG. 20 illustrates a side cross-sectional view of a concrete anchor system as illustrated in FIGS. 2A-B or 3A-B as used in an exemplary concrete slab utilizing yet another alternative placement.
Figure 19:
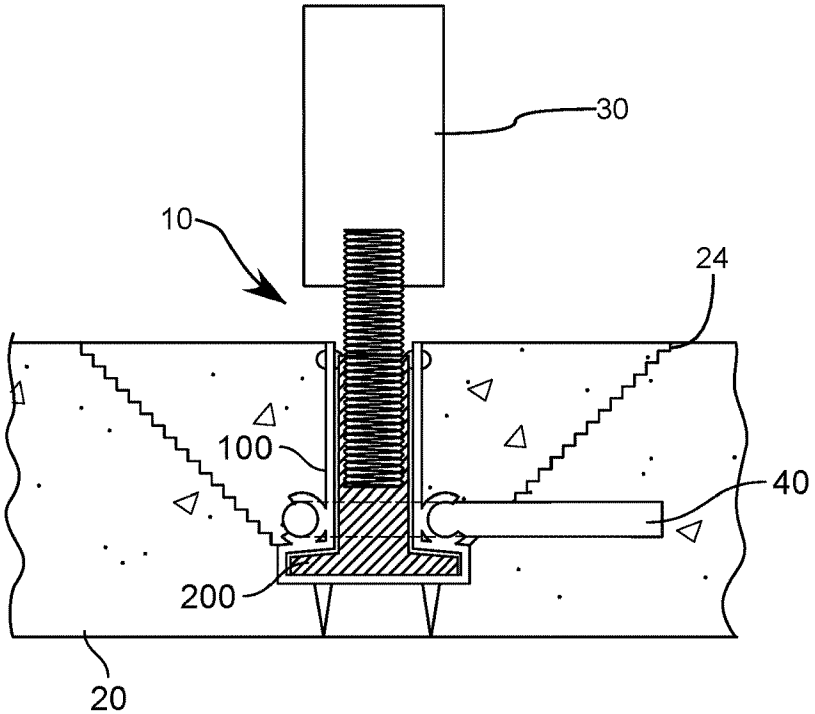
FIG. 19 illustrates a side cross-sectional view of a concrete anchor system as illustrated in FIGS. 2A-B or 3A-B as used in an exemplary concrete slab utilizing an alternative placement.

The depth of the extended body also allows an increased shear force as some of the shear force is transferred into the concrete surrounding the sides of the extended body (see FIGS. 18-20). The depth of the outwardly extending flanges 130 within the concrete slab, is in part determinative of the load that can be placed on the sliding insert and transferred through the flanges 230 of the sliding inserts. The concrete anchor systems provided herein also allows for a lower nut base bearing area that again uses the concrete breakout as a tension capacity mechanism.

FIGS. 10A-C and 12 illustrate an embodiment of an embedded concrete system 10 wherein the extended body 100C and 100J respectively each have a tapered-in or contoured outer surface. The sliding inserts 200C and 200J respectively contemplated for use with this system can have a corresponding contoured shape corresponding in shape to the contoured outer surface of the extended bodies. This embodiment provides one or more contours in which the extended body can engage with the cured concrete surrounding it, thus further decreasing the likelihood that the sliding insert and/or the extended body can be pulled or sheared out of the cured concrete thus transferring a larger portion of any load into the concrete.

As illustrated in FIGS. 5A-B, 6A-B, 10A-C, 11A-C, 12, 18, 19 and 20, the internal portion of the elongated slot 110, extended body 100, 100A, and opposing flanges 130 can be formed to match the contours or external shape of the sliding inserts 200A-J.

Figure 23:
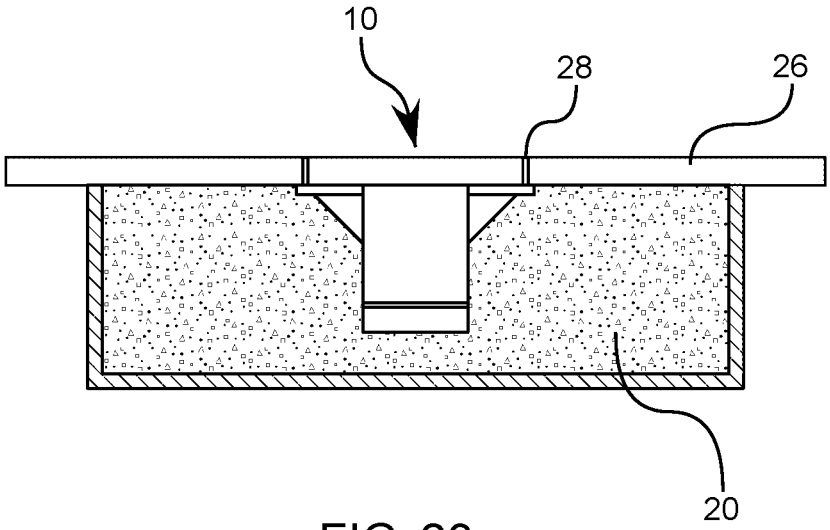
FIG. 23 illustrates a side cross-sectional view of a concrete anchor system as illustrated as used in an exemplary concrete slab utilizing yet another alternative placement.
Figure 24:
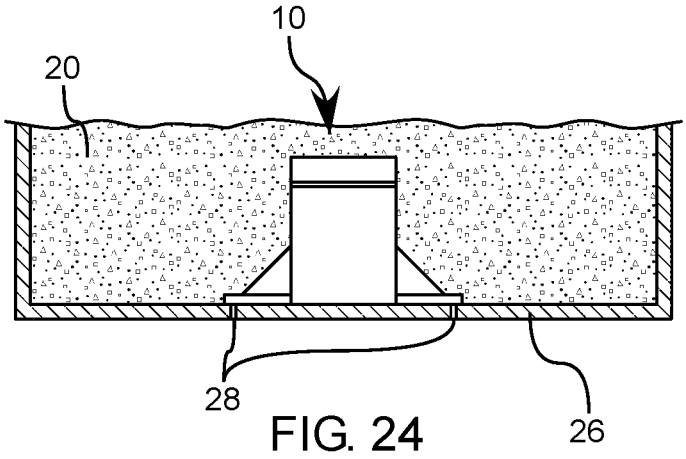
FIG. 24 illustrates a side cross-sectional view of a concrete anchor system as illustrated as used in an exemplary concrete slab utilizing yet another alternative placement.

FIGS. 14A-D illustrate an alternative end cap 400C which illustrates various potential structures having use in the concrete anchor systems as discussed herein. The end cap 400C is provided with an extended flange portion 470 extending from a top edge of the end cap 400C, the extended flange portion 470 can be utilized for attachment to an upper or bottom portion of a mold 26 through aperture 474, using wire hangars, nails, or screws 28, so as to facilitate proper placement as the concrete is poured around the anchor system 10, particularly when flush edge placement is desired or most convenient, as illustrated in FIGS. 23-24. In order to minimize deflection of the extended flange portion 470 under load, a buttress 480 can be provided between the front face of the end cap and the extended flange portion 470 so as to ensure that the flange does not bend up or down during the curing process.

Also, illustrated in FIGS. 14A-D is an exemplary attachment means between the end caps and the extended bodies, in this embodiment the end cap can be provided with a plurality of hooked tabs 460, which hooked tabs are configured to engage a corresponding channel provided around the edge of a particular channel. It will be appreciated that the tabs can also provide a certain degree of press or interference fit through plastic or elastic deformation about the edge of a particular extended body even absent a corresponding channel being provided about an interior surface of the edge.

Figure 21:
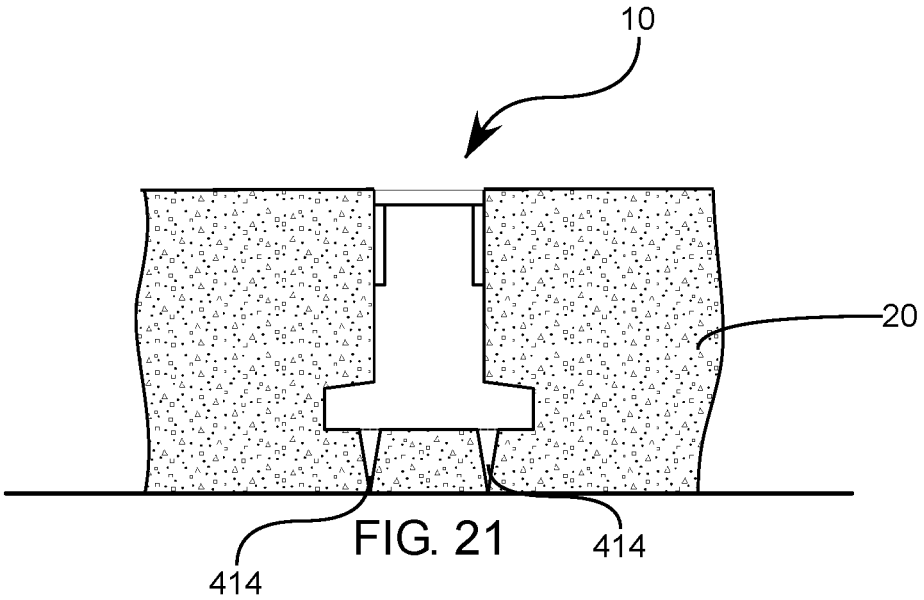
FIG. 21 illustrates a side cross-sectional view of a concrete anchor system as illustrated in FIGS. 1A-B as used in an exemplary concrete slab utilizing yet another alternative placement.
Figure 22:
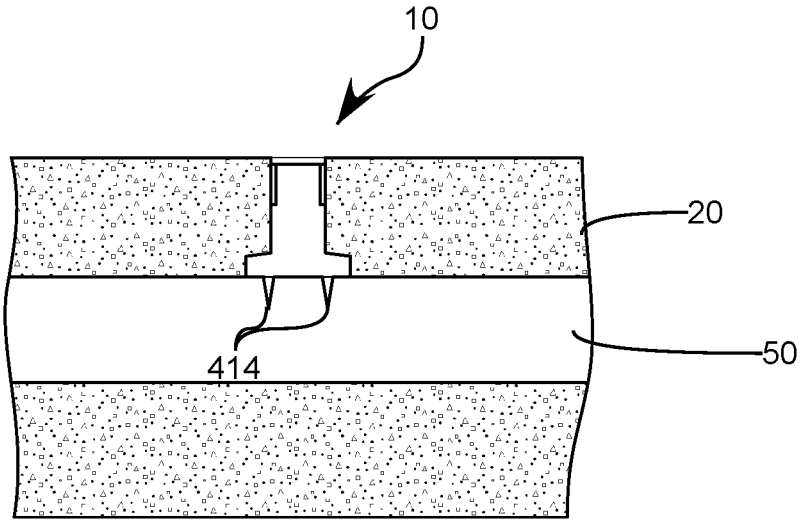
FIG. 22 illustrates a side cross-sectional view of a concrete anchor system as illustrated in FIGS. 1A-B as used in an exemplary concrete slab utilizing yet another alternative placement.

Also illustrated in the various views of the various views of the end caps is a plurality of spacing footers 414 which can be provided on a bottom edge of the various end caps. the spacing footers can be provided at a pre-determined length so as to ensure that uncured concrete can easily flow beneath the extended body during the pouring steps. It has been appreciated that it may be advantageous to provide the spacing footers with a perforated connection portion 415 which allows them to be easily broken or snapped off in situations where the spacing footers are not needed. The spacing footers 414 allow for the anchor system to be properly spaced within the concrete slab by either standing the anchor system a pre-determined distance from the bottom of the mold, as shown in FIGS. 19 and 21, or by embedding the spacing footers into an intermediate mold or insulation structure 50, as shown in FIGS. 20 and 22.

Figure 16A:
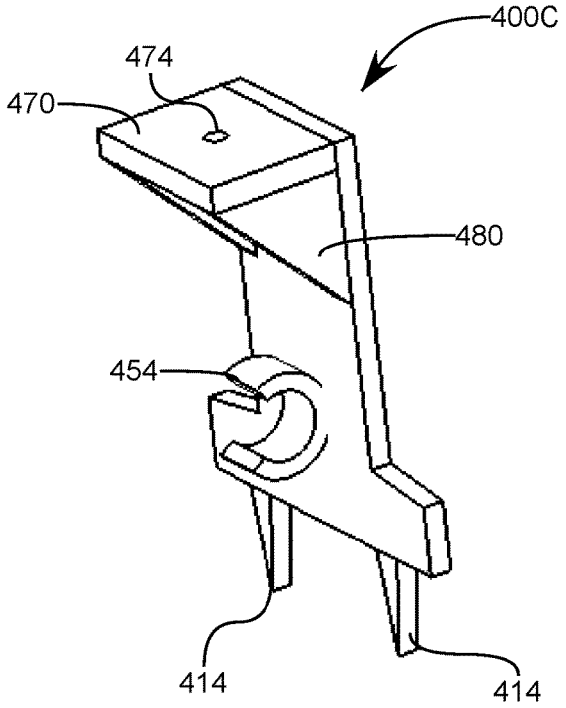
FIGS. 16A-B illustrate perspective and front detailed views respectively of the end cap as illustrated FIGS. 4A-B thus illustrating yet additional aspects of the present invention.
Figure 16B:
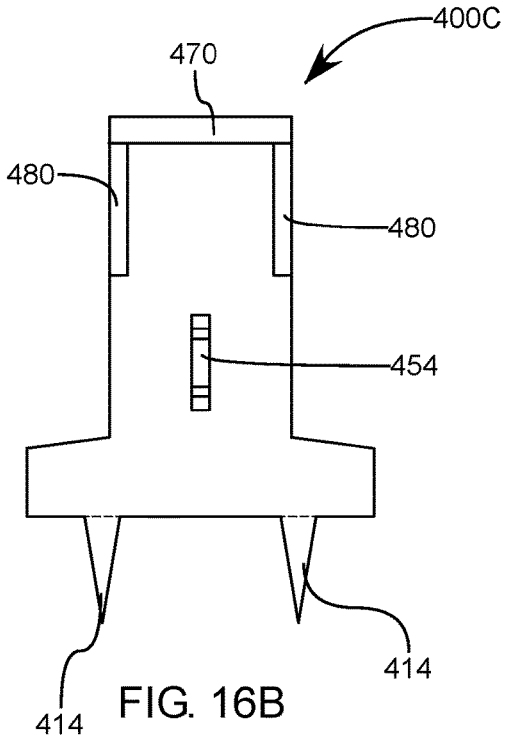
Figure 17:
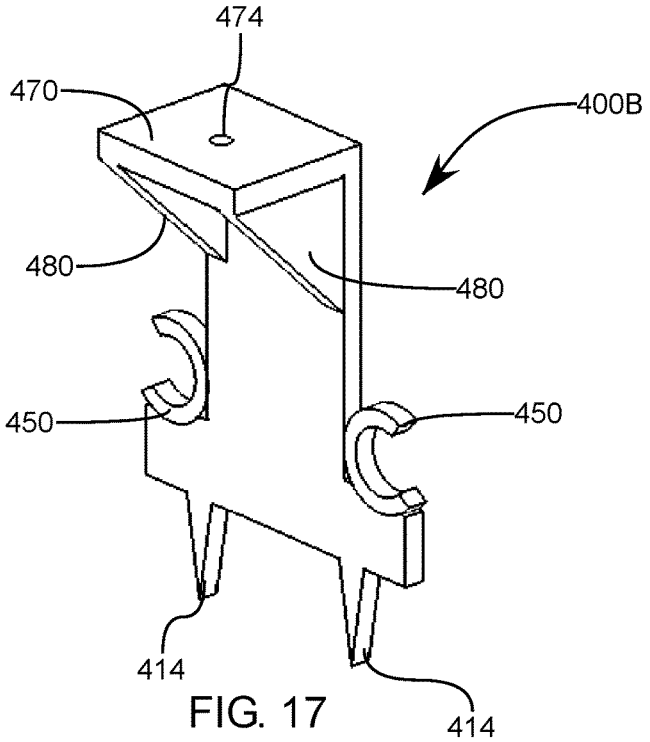
FIG. 17 illustrate a perspective detailed view of the end cap as illustrated FIGS. 3A-B thus illustrating yet additional aspects of the present invention.

FIGS. 16A-C illustrate yet another exemplary embodiment of an end cap 400D which includes a sealing lip 464 which can be configured to press fit into the end of a given extended channel.

FIGS. 18-20 in particular illustrate how the anchor system 10 can be embedded within a concrete slab 20 and a strap or other attachment assembly 30 can be threaded into the sliding insert 200. Upon curing, the concrete slab supports the shape of the corresponding channel and is affixed to an internal support structure 40. In this manner, even upon development of a crack 24 in the concrete, the sliding insert and strap assembly can transfer the load into the internal support structure through the various flanges.

It is further appreciated that certain advantages are realized through using a malleable material to form the extended bodies 100. This being because as the sliding insert 200 is attached to and placed under load, the transfer of force between the flange 230 and the concrete can cause a compression and slight disbursement of the point load between the flange and the concrete, thus reducing the chances of cracking.

Also contemplated herein is a method of providing a concrete anchor system within a concrete slab, the method including the steps of: providing a mold form; providing an extended body embeddable within a concrete slab, the extended body having a slot portion having a predetermined depth and one or more flange portions extending outwardly from the slot portion; providing a sliding insert having a connection portion extending along the depth of the slot portion, the sliding insert also having one or more flange portions corresponding in shape to the one or more flange portions of the of the extended body; providing one or more end caps configured to seal opposing ends of the extended body; providing a slot cap along the length of the extended body to seal the slot portion; affixing the extended body or at least one end cap to an internal support structure; adding uncured concrete into the mold form around the extended body; allowing the concrete to cure; and removing the slot cap after curing is complete.

The method can also include optional steps such as: providing a plurality of spacing footers about a bottom edge of each end cap; and positioning the spacing footers such that the extended body is spaced away from a bottom surface of the mold form thus allowing for the uncured concrete being added to the mold form to flow beneath the extended body.

It will be appreciated that the extended body can be formed unitarily with the end caps and the top caps. In some such methods, the end caps and top caps can have a common unitary edge which is folded over to seal during the concrete pouring and curing. Further, in some embodiments the end caps can be fully sealed or unitary about common edges with the extended body wherein the sliding insert can be inserted through the top surface with the flange portions extending along the length of the slot, and then twisted so as to engage the respective flange portions into the bottom flange portion of the extended body wherein the top cap can then be sealed over the insert during the concrete pouring and curing process.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention. Additionally, any features, structures, components, method steps which are discussed in reference to any one of the aforementioned embodiments are readily adaptable for use into and with any features of the other alternative embodiments discussed therein, with the understanding that one of ordinary skill in the art will be capable of assessing the ability of the various embodiments disclosed and be capable of making such adaptations.

What is claimed:

1. A concrete anchor system, the system comprising:

an extended body embeddable within a concrete slab, the extended body having a slot portion having a predetermined depth and one or more flange portions extending outwardly from the slot portion, the slot having an open end provided at an opposing end from the one or more flange portions;

one or more sealing channels provided about opposing interior surfaces of the slot proximal the open end of the slot a sliding insert having a connection portion and one or more flange portions corresponding in shape to the one or more flange portions of the of the extended body, wherein the connection portion of the sliding insert extends from the flange portions of the slot along the predetermined depth of the slot to at least the one or more sealing channels provided about the open end of the slot; and one or more end caps configured to seal opposing ends of the extended body.

2. The concrete anchor system of claim 1, wherein the connection portion and the flange portions of the sliding insert are formed unitarily.

3. The concrete anchor system of claim 1, wherein the connection portion and the flange portions of the sliding insert are formed separately, the flange portion having a male threaded portion corresponding to a lower female threaded portion of the connection portion.

4. The concrete anchor system of claim 1, wherein the sliding insert includes female threads disposed about an inner surface of the connection portion.

5. The concrete anchor system of claim 1, further comprising:

one or more reinforcement attachment means provided being provided on an exterior surface of the extended body between the one or more flange portions and the slot portion.

6. The concrete anchor system of claim 1, further comprising:

one or more reinforcement attachment means provided on an exterior surface of the one or more end caps.

7. The concrete anchor system of claim 1, further comprising:

one or more reinforcement attachment means provided on opposing edges of the one or more end cap.

8. The concrete anchor system of claim 1, further comprising:

a slot cap provided about a top edge of the extended body and engaging with the one or more sealing channels, wherein the end caps and slot cap hermetically seal an interior cavity of the extended body during and after a concrete curing process.

9. The concrete anchor system of claim 5, wherein the one or more reinforcement attachment means is provided as a semi-circular shape corresponding in diameter to a reinforcement structure provided within the concrete slab.

10. The concrete anchor system of claim 6, wherein the one or more reinforcement attachment means is provided as a semi-circular shape corresponding in diameter to a reinforcement structure provided within the concrete slab.

11. The concrete anchor system of claim 1, further comprising:

a slot cap provided about a top edge of the extended body, wherein the end caps and slot cap hermetically seal an interior cavity of the extended body during and after a concrete curing process.

12. The concrete anchor system of claim 1, wherein the at least one end caps further comprise one or more spacing footers provided about a bottom edge.

13. The concrete anchor system of claim 1, wherein the anchor system comprises a plurality of end caps, wherein each end cap further comprises an extended flange portion extending perpendicularly from an end face about a top edge.

14. The concrete anchor system of claim 1, wherein the extended body is formed of a metallic material.

15. The concrete anchor system of claim 1, wherein the extended body is formed of a material having a hardness being lower than that of the sliding insert.

16. The concrete anchor system of claim 15, wherein the extended body is formed of a plastic or polymer material and the sliding insert is formed of a metallic material.

17. The concrete anchor system of claim 1, wherein the outwardly extending flanges are configured to transfer a load placed on the sliding insert to the concrete slab, and wherein a load capacity of the concrete anchor system is in part dependent on predetermined depth at which the embedded outwardly extending flanges rest within the concrete slab.

* * * * *